US010094386B2

(12) United States Patent
Ziegler et al.

(10) Patent No.: US 10,094,386 B2
(45) Date of Patent: Oct. 9, 2018

(54) RADIATOR FAN OF A MOTOR VEHICLE

(71) Applicant: BROSE FAHRZEUGTEILE GMBH & CO. KG, WUERZBURG, Wuerzburg (DE)

(72) Inventors: Thomas Ziegler, Schwebenried (DE); Thomas Hussy, Wittighausen (DE); Artur Schmidt, Wuerzburg (DE); Thomas Schencke, Langewiesen (DE)

(73) Assignee: Brose Fahrzeugteile GmbH & Co. Kommanditgesellschaft., Wuerzburg (DE)

( * ) Notice: Subject to any disclaimer, the term of this patent is extended or adjusted under 35 U.S.C. 154(b) by 87 days.

(21) Appl. No.: 14/444,011

(22) Filed: Jul. 28, 2014

(65) Prior Publication Data

US 2014/0334952 A1 Nov. 13, 2014

Related U.S. Application Data

(63) Continuation of application No. PCT/EP2013/000243, filed on Jan. 28, 2013.

(30) Foreign Application Priority Data

Jan. 28, 2012 (DE) ..... 20 2012 000 939 U

(51) Int. Cl.
*F04D 29/00* (2006.01)
*F04D 25/06* (2006.01)
(Continued)

(52) U.S. Cl.
CPC ..... *F04D 25/0606* (2013.01); *F04D 19/002* (2013.01); *F04D 29/263* (2013.01); *F04D 29/329* (2013.01); *F04D 29/646* (2013.01)

(58) Field of Classification Search
CPC .. F04D 25/0606; F04D 29/646; F04D 29/329; F04D 29/263; F04D 19/002
(Continued)

(56) References Cited

U.S. PATENT DOCUMENTS 3,642,382 A * 2/1972 Hayashi ..... F04D 25/022 415/129
3,885,888 A * 5/1975 Warhol ..... F04D 29/329 416/175
(Continued)

FOREIGN PATENT DOCUMENTS

CN 102667170 A 9/2012
CN 202579222 U 12/2012
(Continued)

OTHER PUBLICATIONS

Machine Translation of WO 2010130577.*
"Rivet-Wikipedia, the free encyclopedia.pdf.", 2011.*

*Primary Examiner* — Devon Kramer
*Assistant Examiner* — Christopher Bobish
(74) *Attorney, Agent, or Firm* — Laurence A. Greenberg; Werner H. Stemer; Ralph E. Locher

(57) ABSTRACT

A radiator fan of a motor vehicle, in particular a main fan, contains a fan wheel which has a hub and an electric-motor rotor which is attached thereto in a form-locking manner. At least one connecting dome is formed integrally on the rotor, which connecting dome protrudes through a corresponding cutout of the hub and is deformed on the free end side in a rivet-shaped manner in order to produce the form-locking connection.

14 Claims, 3 Drawing Sheets

(51) Int. Cl.

| | |
|---|---|
| ***F04D 19/00*** | (2006.01) |
| ***F04D 29/32*** | (2006.01) |
| ***F04D 29/26*** | (2006.01) |
| ***F04D 29/64*** | (2006.01) |

(58) Field of Classification Search
USPC .... 416/169 A; 417/423.15, 423.14, 352–354
See application file for complete search history.

(56) References Cited

U.S. PATENT DOCUMENTS 4,384,824 A * 5/1983 Woods ..... F16D 1/06 123/41.11
4,554,491 A * 11/1985 Plunkett ..... H02K 29/08 310/186
4,566,864 A * 1/1986 Yamamoto ..... F04D 25/0653 310/268
4,698,542 A * 10/1987 Muller ..... H02K 29/08 310/67 R
5,188,508 A * 2/1993 Scott ..... F04D 29/281 415/206
RE34,456 E * 11/1993 Harmsen ..... F04D 25/0613 417/354
5,593,283 A * 1/1997 Scott ..... F04D 19/002 416/169 A
5,944,497 A * 8/1999 Kershaw ..... F04D 25/082 417/368
6,384,494 B1 * 5/2002 Avidano ..... H02K 9/06 310/58
6,400,051 B1 * 6/2002 Hsieh ..... H02K 5/15 310/261.1
6,511,303 B2 1/2003 Obara
7,042,121 B2 5/2006 De Filippis et al.
7,701,098 B2 * 4/2010 Yang ..... F04D 29/646 310/216.124
7,977,831 B2 * 7/2011 De Filippis ..... F04D 25/082 310/58
8,157,524 B2 * 4/2012 Nicgorski ..... F04D 29/663 416/169 A
8,251,674 B1 * 8/2012 Pairaktaridis ..... H02K 9/06 310/62
D726,300 S * 4/2015 DeFilippis ..... F04D 29/646 D23/414
2004/0191088 A1 * 9/2004 Matsumoto ..... F04D 25/0613 417/354
2007/0280829 A1 * 12/2007 Stevens ..... F04D 29/326 416/189
2012/0183417 A1 * 7/2012 Linnenbrock ..... F04D 29/263 417/410.1
2012/0224988 A1 * 9/2012 Maier ..... F04D 29/646 417/423.1

FOREIGN PATENT DOCUMENTS

| | | | | |
|---|---|---|---|---|
| DE | 4441649 | A1 | 5/1996 | |
| DE | 102009003142 | A1 | 11/2010 | |
| EP | 0921318 | A2 | 6/1999 | |
| EP | 1174623 | A2 | 1/2002 | |
| EP | 1621773 | A1 | 2/2006 | |
| JP | S54162910 | U | 11/1979 | |
| JP | 2002039091 | A | 2/2002 | |
| WO | WO 2010130577 | A2 * | 11/2010 | ..... F04D 29/263 |

* cited by examiner

RADIATOR FAN OF A MOTOR VEHICLE

CROSS-REFERENCE TO RELATED APPLICATION

This is a continuation application, under 35 U.S.C. § 120, of copending international application No. PCT/EP2013/000243, filed Jan. 28, 2013, which designated the United States; this application also claims the priority, under 35 U.S.C. § 119, of German patent application No. DE 20 2012 000 939.7, filed Jan. 28, 2012; the prior applications are herewith incorporated by reference in their entireties.

BACKGROUND OF THE INVENTION

Field of the Invention

The invention relates to a radiator fan of a motor vehicle, in particular a main fan, having a fan wheel, which has a hub, and has an electric-motor rotor attached thereto.

During operation, motor vehicles having an internal combustion engine exhibit considerable heat generation. To maintain the operating temperature of the internal combustion engine and also to operate an air conditioning system, use is generally made of a liquid coolant, which must, in turn, be cooled. This is generally accomplished by a radiator system, which is acted upon by a relative wind and which is in a relationship of heat exchange with the coolant. For example, the coolant is passed into tubes that are incorporated into the radiator system. Since the relative wind is normally insufficient for cooling, particularly at low vehicle speeds, published, European patent application EP 1 621 773 A1 (corresponding to U.S. Pat. No. 7,042,121), for example, discloses the use of an electric fan, by which the relative wind is intensified.

Here, the fan is arranged behind the radiator system in the direction of travel. With the aid of a fan wheel of the fan, air is sucked through the radiator system and directed at the internal combustion engine. If there is a condenser system of a condenser of an air-conditioning system in addition to the radiator system, the condenser system is generally arranged ahead of the radiator system in the direction of the relative wind.

The fan wheel is connected to a rotor shaft of the electric motor or the rotor thereof by a central rotor shaft clutch. Other conventional measures of fastening the fan wheel to the rotor have screws. These are screwed into the rotor through the fan wheel from the side thereof facing away from the electric motor. Generally, three such screws are used. It is furthermore known to join the fan wheel to the rotor shaft by press fitting or to fix them to one another by a bayonet joint.

SUMMARY OF THE INVENTION

It is the underlying object of the invention to indicate an improved radiator fan of a motor vehicle, the fan having, in particular, a relatively low weight and preferably also being suitable for assembly with high manufacturing tolerances while complying with the functionally relevant dimensions.

The radiator fan is part of a motor vehicle and, in particular, is used to cool an internal combustion engine. For this purpose, relative wind is directed through a radiator system, wherein the relative wind is intensified by the radiator fan or generated when the vehicle is stationary. For this purpose, the radiator fan has a fan wheel having a number of fan blades. The fan blades are attached to a central hub. Attachment can be accomplished by additional elements, e.g. screws, or by a material bond. In particular, the fan wheel is composed of a plastic and is produced integrally in an injection molding process. Rotation is imparted to the fan wheel by an electric motor. For this purpose, the fan wheel is connected to a rotor of the motor. For example, the electric motor is a brushless internal rotor motor and the rotor is thus arranged within a stator of the electric motor.

Attachment is accomplished by use of at least one connecting dome, which is formed integrally on the rotor. During the mounting of the fan wheel on the rotor, the connecting dome is passed through an aperture corresponding thereto in the hub of the fan wheel, and the free end of the connecting dome is deformed. For this purpose, the free end is, in particular, heated and plastically deformed, in particular by staking. The deformation or staking is rivet-shaped. In other words, the free end of the connecting dome is widened, thus providing a particularly reliable, weight-saving and easy-to-assemble fan wheel/rotor connection by staked domes or nobs. In this process, the widening is relatively large, being at least larger than the diameter of the corresponding aperture, thus preventing the fan wheel from being removed from the rotor without damaging the connecting dome or other parts of the rotor.

Owing to the widening of the free end, the connecting dome is shortened in comparison with the original state, and the fan wheel is held force-lockingly and/or form-lockingly between the rivet-shaped head of the connecting dome and the rotor. In this way, the fan wheel is fixed at least in the axial direction of the electric motor and is not detached from the latter during operation. By the form-locking nature of the joint, axial movement of the fan wheel in relation to the electric motor is likewise prevented, thereby preventing unwanted noise evolution.

It is advantageous if the rotor has a number of such connecting domes and the hub has the same number of corresponding apertures. As a particularly preferred option, the number of apertures and connecting domes is four in each case. Relatively secure attachment of the fan wheel to the rotor is thus provided, while the assembly time is relatively short. Moreover, the weight of the joint is relatively low and, owing to the use of four domes, there is a sufficient safety margin, e.g. in the case where one of the connecting domes breaks.

It is expedient if the connecting dome or domes runs/run parallel to the rotor axis of the electric motor, which is also referred to below as the axis of rotation. This allows relatively simple mounting of the fan wheel since it merely has to be pushed onto the rotor. Time-consuming positioning of the motor and of the fan wheel relative to one another that might be necessary is eliminated. All that is required is that either the fan wheel or the rotor should be turned into an appropriate position. If the connecting dome is positioned at a relatively large distance from the rotor axis, it can furthermore be used to transmit power to the fan wheel. In the case of alignment substantially parallel to the rotor axis, power transmission and the stress on the connecting dome during this process are independent of the direction of rotation of the rotor. In other words, the electric motor can be operated in both directions, with the fan wheel being connected securely to the rotor and not being detached by a rotary motion in either case. In the case of parallel alignment of the connecting dome, the form-locking connection between the fan wheel and the rotor is furthermore relatively stable. In particular, the form-locking connection is established primarily by the rivet-shaped head of the connecting dome and other components of the rotor that are situated on the opposite side of the fan wheel from the rivet head. The fan wheel is thus fixed substantially by a clamping action between the rivet head and the component. With a connecting dome of this kind, relatively high clamping forces are transmitted while minimizing stress on the material.

In a preferred embodiment, one or, in particular, a plurality of stabilizing ribs is formed integrally on the rotor side of the connecting dome. It is expedient if the stabilizing ribs are situated in the region of the transition from the connecting dome to the rotor. It is appropriate for one stabilizing rib to be plate-shaped and arranged parallel to the alignment of the connecting dome. In particular, a number of stabilizing ribs surrounds the connecting dome in a star shape. In this case, the number of stabilizing ribs is at least two and preferably six. By the stabilizing ribs, the connecting dome is stabilized, thus preventing the connecting dome from being torn away from the rotor or bent over in the region of the transition between the rotor and the connecting dome when subjected to a load, e.g. during the operation of the fan or during the mounting of the fan wheel.

The stabilizing rib furthermore forms a defined point of support for the fan wheel, thus making it possible to choose relatively large tolerances for the position and size of the apertures in the hub, particularly when using a plurality of connecting domes, while nevertheless allowing secure assembly. The stabilizing rib likewise forms a defined point of support for the fan wheel, thus making the clamped fixing of the fan wheel between the rivet head of the connecting dome and the supporting surface for the fan wheel on the stabilizing rib relatively secure and stable. The clamping force acting on the fan wheel is thus advantageously increased.

By way of example, the rotor contains two, in particular four, connecting domes. It is expedient if two, in particular all, of the connecting domes are at the same distance from the axis of rotation of the rotor. In other words, the connecting domes are at the same distance radially from the rotor axis. By such a choice of distance between the connecting domes and the rotor axis, unbalance of the rotor is avoided, leading to relatively smooth running of the electric motor and thus of the cooling fan. In particular, the distance between the connecting domes and the axis of rotation is relatively large and the connecting domes are preferably situated in the region of the outer third of the rotor. As a further means of avoiding unbalance of the rotor, it is expedient to arrange the individual connecting domes in a rotationally symmetrical manner relative to the axis of rotation.

The rotor preferably contains a centering ring on its surface. In this arrangement, the central point of the centering ring, which is, in particular, circular, is situated substantially on the rotor axis, and the centering ring is inserted into the surface of the rotor on the end face or front side of the rotor, wherein the contour of the centering ring is arched outward, i.e. in the direction of the fan wheel. In this arrangement, the centering ring is of cylindrical construction, in particular of hollow-cylindrical construction. The centering ring engages in a centering opening in the hub, which likewise has a hollow-cylindrical shape. It is advantageous if the center of the centering opening and of the centering ring is on the axis of rotation in the assembled state. In other words, the centering opening and the centering ring are arranged concentrically. In this case, the inside of the centering opening surrounds the outer circumferential side of the centering ring. However, it would likewise also be conceivable for the centering ring to surround the rotation opening. In this case, the centering opening can also be in the form of a cylinder or of a truncated cone, wherein the height of the cylinder or frustum is relatively small.

In particular, the centering opening and the centering ring rest positively on one another. The centering opening is expediently pot-shaped. In other words, the centering opening has a bottom. On the side facing away from the rotor, the hub is thus not open in the region of the centering opening, and therefore a flow of air can flow past the hub relatively unhindered without the formation of a relatively large amount of turbulence, which would lead to increased noise pollution. Arranging the centering opening and the centering ring one inside the other ensures that the fan wheel is positioned in a relatively accurate manner. When producing the rotor and the fan wheel, it is thus possible to choose relatively large manufacturing tolerances in the region of these two connecting elements as well, while the desired axis of rotation of the fan wheel nevertheless coincides with the axis of rotation of the rotor.

It is expedient if the rotor has a driver rib, in particular a number of driver ribs. In the assembled state of the fan, the driver rib or driver ribs engages/engage in a slot corresponding thereto in the hub. For example, the driver rib is arranged force-lockinlgy and/or form-lockingly in the slot. The driver rib is preferably arranged at a relatively large distance from the axis of rotation and, in particular, is situated on the end face of the rotor. By the driver rib, the rotary motion of the rotor is transmitted to the fan wheel. Power transmission is thus accomplished without the aid of the connecting dome or at least only partially with the aid of the connecting dome, which is therefore subjected to no mechanical stress or only a slight mechanical stress. The life of the connecting dome or domes is therefore advantageously increased. It is advantageous if the driver rib or each driver rib extends radially. This means that power transmission is relatively high, while the rotor can be operated reliably in both directions of rotary motion without the occurrence of slip between the rotor and the fan wheel.

In particular, the driver rib or driver ribs is/are formed integrally on the centering ring. For example, the centering ring and the driver ribs are produced integrally. This leads both to relatively low-cost manufacture and also to relatively high stability both of the centering ring and of the driver ribs, which support each other.

As a particularly preferred option, the slots are introduced into a boundary contour of the centering opening. For example, the slots are situated in the circumferential surface of the hollow-cylindrical centering opening, with the result that the opening is formed at least partially by a number of hollow-cylinder segments. As a result, the number and weight of the fan wheel elements used to connect the fan wheel to the rotor is relatively small, and therefore the fan wheel has a relatively low inertia.

In a particularly preferred embodiment, the connecting dome is integral with an electrically insulating plastic overmolding of a laminated rotor core of the rotor. In other words, the connecting dome is produced in a single working step of the manufacture of the rotor, the step likewise serving to protect against electrical short-circuiting of individual components of the rotor. The individual components are field windings of a coil, for example, by which a magnetic field is produced or, as an alternative, are individual rotor laminations, which are insulated from one another and essentially form the laminated rotor core in order to avoid eddy current formation. This eliminates separate production of the connecting dome and subsequent attachment thereof to the already insulated laminated rotor core, and this leads to a cost and time saving.

As an alternative or in combination therewith, the centering ring and/or, in particular, the driver rib are integral in the same way with the plastic over-molding. In addition to the advantages already mentioned, there is a resultant increase in the stability of the individual components and of their connection to the rotor. It is furthermore made possible to position the centering ring and hence also the fan wheel in a relatively precise manner on the rotor.

In a suitable embodiment, the hub of the fan wheel forms a cover for the rotor. In other words, the rotor is open on the side facing the fan wheel and is protected by the hub from damage or contamination. This allows a reduction in the weight of the electric motor, thereby reducing the inertia thereof. Thus, the electric motor and the radiator fan respond relatively quickly to a change in control input, while relatively low forces are nevertheless employed.

In a particularly preferred embodiment of the invention, the connecting dome is of hollow-cylindrical construction. This allows a saving of material for the connecting dome without reducing the stability of the connecting dome. In addition or instead, the connecting dome is cylindrical. In other words, the connecting dome has a cylindrical shape, in particular a right cylindrical shape, wherein the base surface is round for example. It is expedient here if the cylinder axis is parallel to the axis of rotation of the rotor. For example, the connecting dome is shaped as a hollow-cylindrical tube. However, it would likewise also be conceivable for the connecting dome to have a base surface deviating from a circular shape. In this arrangement, it is expedient if the corresponding aperture in the hub is shaped in a manner corresponding to the base surface. A suitable choice of geometry for the connecting dome makes it possible to establish a relatively stable joint between the fan wheel and the rotor, while the weight of the joint is reduced.

In a particularly suitable development, a depression, within which the corresponding aperture is situated, is introduced into the hub. In particular, the depression is offset in the direction of the rotor. In the assembly state, it is expedient if the rivet head of the connecting dome fills the depression substantially completely. This provides a relatively large power transmission area for the form-locking joint serving to connect the fan wheel to the rotor. The side of the hub facing away from the rotor is likewise of relatively flat shape, which improves the aerodynamic properties of the radiator fan. It is expedient if the depression is conical or of round hemispherical shape, wherein the diameter of the depression decreases with increasing proximity to the rotor and to the corresponding aperture.

Other features which are considered as characteristic for the invention are set forth in the appended claims.

Although the invention is illustrated and described herein as embodied in a radiator fan of a motor vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts that correspond to one another are provided with the same reference signs in all the figures.

Figure 1:
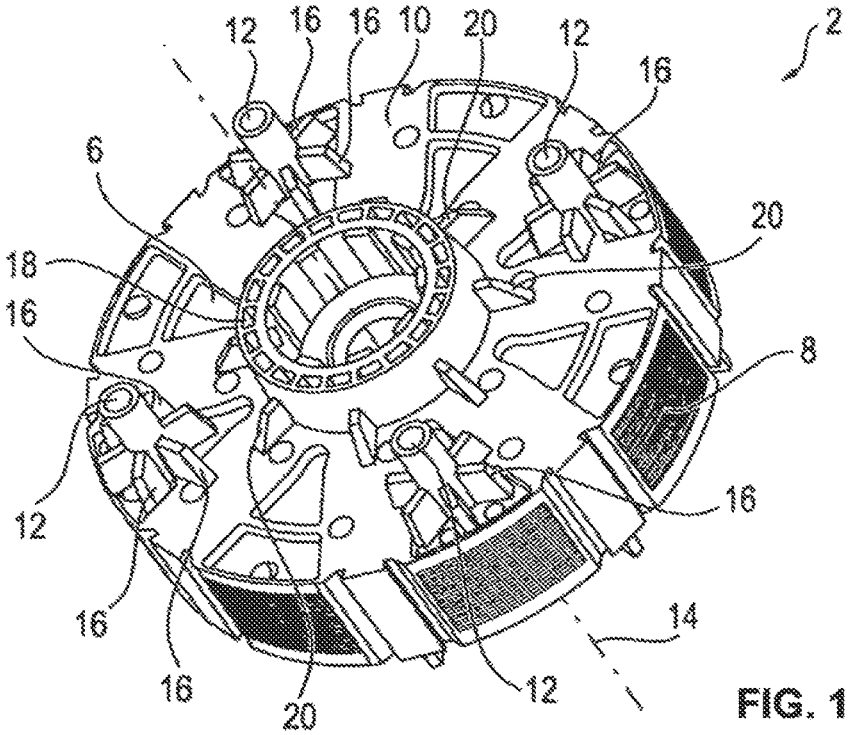
FIG. 1 is a diagrammatic, perspective view of a rotor according to the invention.
Figure 6:
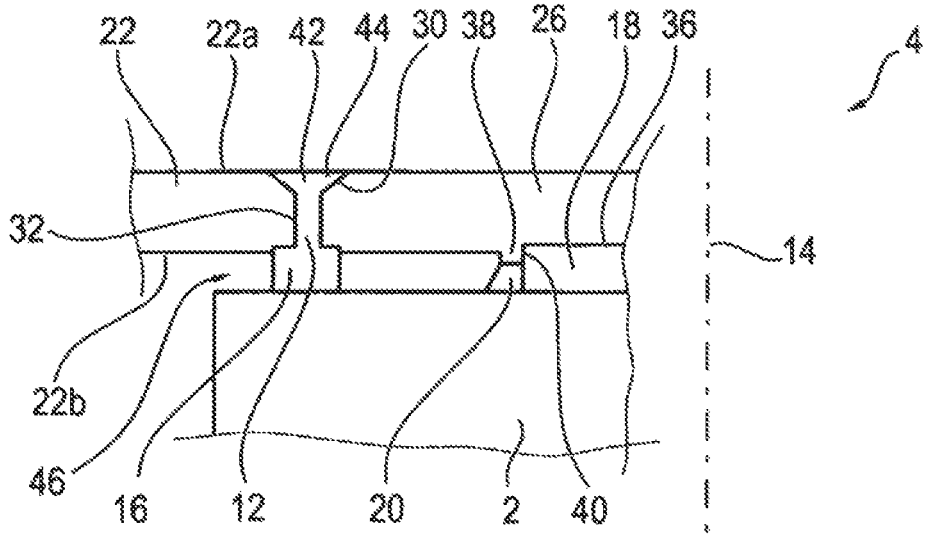
FIG. 6 is an illustration showing a mounting of the fan wheel on a rotor.

Referring now to the figures of the drawings in detail and first, particularly to FIG. 1 thereof, there is shown a cylindrical rotor 2 of a motor vehicle radiator fan 4 shown schematically in FIG. 6. The radiator fan 4 is used to cool an internal combustion engine of the motor vehicle. For this purpose, relative wind is sucked or blown through a radiator system, through which a cooling fluid is passed. The cooling fluid, in turn, serves to cool the internal combustion engine. The radiator fan 4 is furthermore used to provide an air flow that is directed at the internal combustion engine and thus directly cools the latter.

The rotor 2 has a laminated rotor core 6, which contains a number of circular rotor laminations 8 that are stacked axially one above the other, are insulated from one another, are parallel to one another and are held together by fastening measures. The individual rotor laminations 8 are either premagnetized in a particular direction or a magnetic field is induced within the rotor laminations 8 during the operation of the radiator fan 4 by an electric motor stator (not shown here).

The laminated rotor core 6 is surrounded by a plastic over-molding 10, which insulates the laminated rotor core 6 electrically from other components of the electric motor. The plastic over-molding 10 furthermore stabilizes the laminated rotor core 6 and additionally holds the individual rotor laminations 8 together. In addition the plastic over-molding 10 is used to compensate for any unbalance of the laminated rotor core 6, with the result that the rotor runs relatively smoothly within the stator during operation.

Four connecting domes 12 are formed integrally on the plastic over-molding 10. The shape of the connecting domes 12 is that of a hollow cylinder, wherein the respective cylinder axis extends parallel to a rotor axis 14. The rotor axis 14 about which the rotor rotates during operation coincides with the cylinder axis of the rotor 2. Six stabilizing ribs 16 are formed integrally on each of the connecting domes 12 on the rotor side, surrounding the corresponding connecting dome 12 in a star shape. In other words, the stabilizing ribs 16 are situated in the region of the connecting dome 12 which lies closest to the laminated rotor core 6.

Each stabilizing rib 16 is in the form of a small plate, wherein the main direction of extent is parallel to the rotor axis 14. The cross section of the connecting dome/stabilizing rib structure is rotationally symmetrical with respect to an axis parallel to the rotor axis 14 through the center of the respective connecting dome 12. The connecting domes 12 are arranged on a base surface of the cylindrical rotor 2, the surface forming the end face thereof. In this arrangement, the connecting domes 12 are at a relatively large distance from the rotor axis 14, the distance being greater than two thirds of the radius of the rotor 2. The distance between the individual connecting domes 12 and the axis of rotation 14 is the same. The connecting domes 12 are arranged in such a way that each pair of adjacent connecting domes 12 forms a right angled triangle with the axis of rotation 14. The connecting domes 12 are thus distributed in a rotationally symmetrical manner on the end face of the rotor 2.

On the same end face of the rotor 2 on which the connecting domes 12 are situated is an integrally formed centering ring 18, the center of which is on the axis of rotation 14. The centering ring 18 is a hollow cylinder and extends parallel to the axis of rotation 14 away from the laminated rotor core 6. Arranged on the centering ring 18 are a number of driver ribs 20, which surround the centering ring in a star shape. In other words, the trapezoidal and plate-shaped driver ribs 20 extended radially. In this arrangement, the extent of each of the driver ribs 20 in the direction of rotation 14 is less than that of the centering ring 18. The centering ring 18, each driver rib 20, each connecting dome 12 and the respective stabilizing ribs 16 are integral with the insulating plastic over-molding 10. They are all produced in a single process step, namely when the laminated rotor core 6 is over-molded with the mass of material forming the subsequent plastic over-molding 10.

Figure 2:
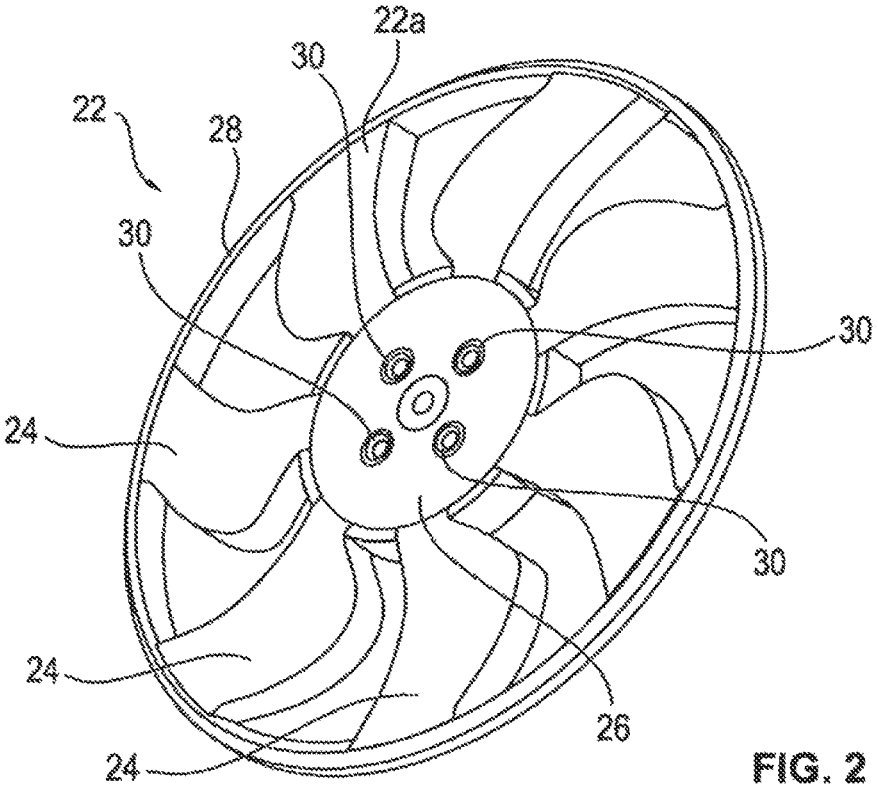
FIG. 2 is a front perspective view of a fan wheel.

FIG. 2 shows a front side 22*a* of the fan wheel 22 of the radiator fan 4 in an unmounted state. The term front side 22*a* is taken to mean that side of the fan wheel 22 which is acted upon by the relative wind during operation while the radiator fan 4 is operating. The fan wheel 22 has a number of fan blades 24, which are attached to a central hub 26. At a circumference, the fan blades 24 are surrounded by a stabilizing ring 28. The stabilizing ring 28 serves to stabilize the fan blades 24 during operation and avoids "leakage air" in a transition zone between the fan wheel 22 and a non-illustrated frame of the radiator fan 4. The fan wheel 22 is produced entirely from a plastic. In other words, the stabilizing ring 28, all the fan blades 24 and the hub 26 are connected materially to one another and are produced in a single working step.

Figure 3:
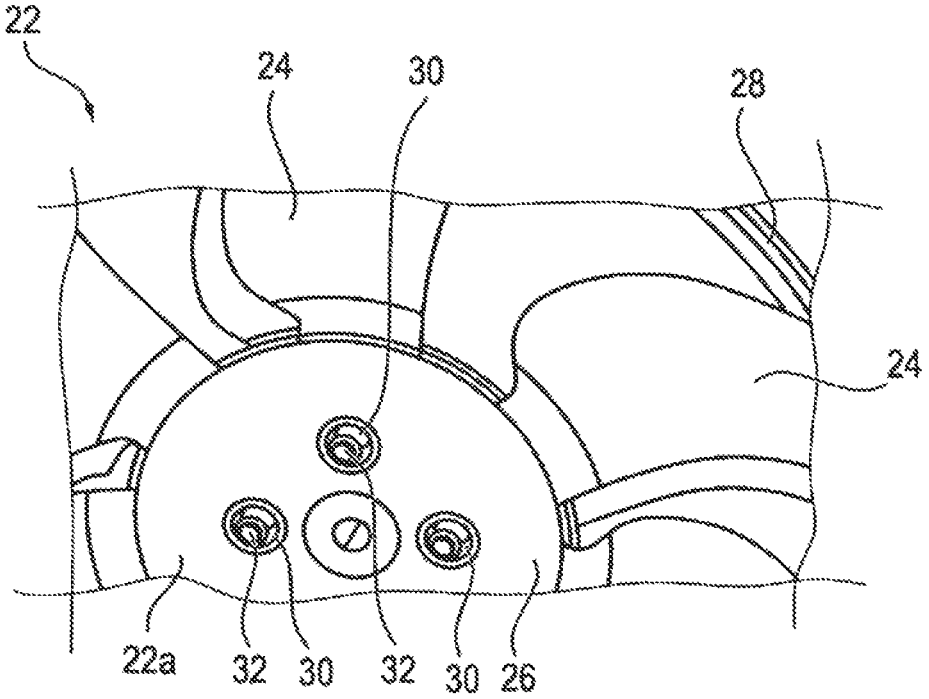
FIG. 3 is a front perspective view of a detail of a hub of the fan wheel.

An enlarged portion of the front side 22*a* of the fan wheel 22 is illustrated in FIG. 3. The front side 22*a* of the fan wheel 22 is relatively smooth and flat in order to avoid turbulence in the relative wind during operation. Four hemispherical depressions 30 are introduced into the hub 26, the depressions arching away from the front side 22*a* of the fan wheel 22 and three of them being shown in FIG. 3. An aperture 32 is introduced at the bottom of each depression 30, i.e. at the point of the depression 30 which is furthest away from the front side 22*a* of the fan wheel 22. Here, each aperture 32 corresponds to one of the connecting domes 12. In other words, the cross section of each aperture 32 corresponds to the external cross section of a respective connecting dome 12. The depressions 30 and the aperture 32 are each arranged in a cross with respect to the center of the fan wheel 22.

Figure 4:
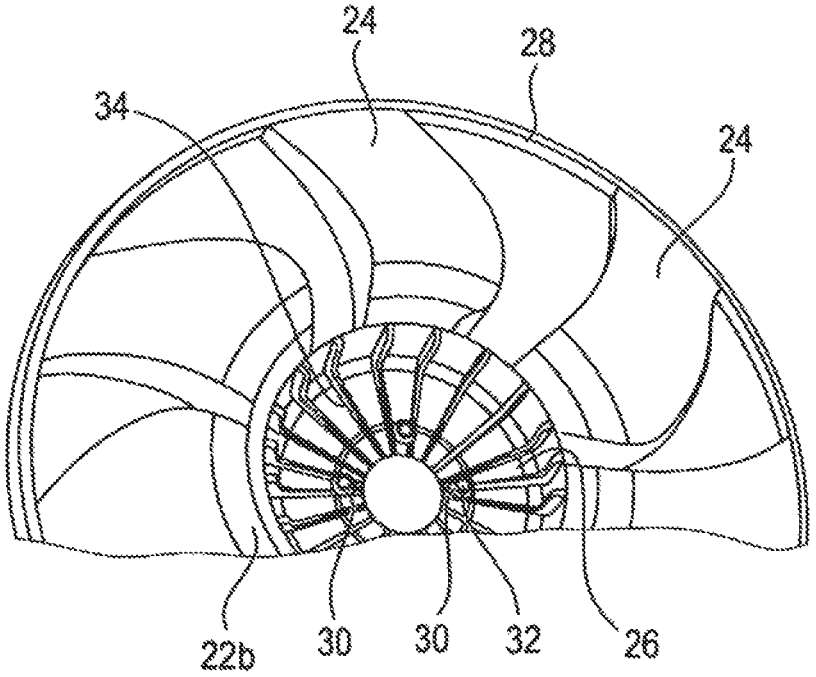
FIG. 4 is a rear perspective view of the fan wheel.
Figure 5:
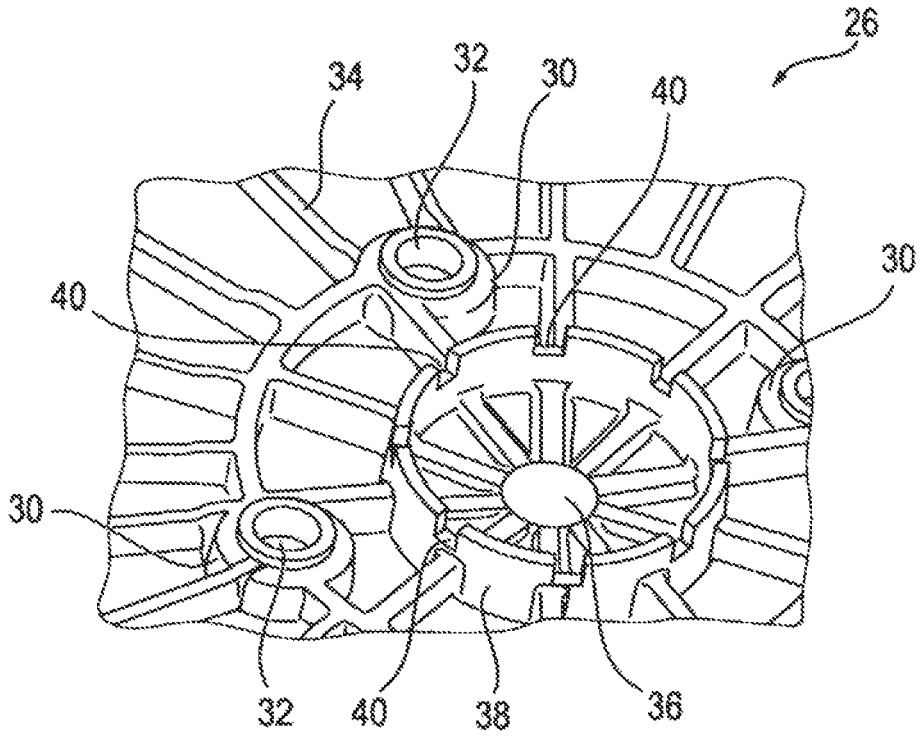
FIG. 5 is a rear perspective view of a detail of the hub of the fan wheel.

FIGS. 4 and 5 show detail views of a rear side 22*b* of the fan wheel 22 in perspective, wherein FIG. 5 shows a detail from FIG. 4. Here, the rear side 22*b* designates the opposite side of the fan wheel 22 from the front side 22*a*. It will be clear from FIG. 4 that the hub 26 is pot-shaped and has a rib structure 34 within the hub 26 to stabilize the hub, which is open toward the rear side 22*b*. In the center of the hub 26 there is a centering opening 36, which is likewise pot-shaped, is concentric with the hub 26 and contains a hollow-cylindrical boundary contour 38. The boundary contour 38 contains a number of slots 40, the depth of which is less than the height of the boundary contour 38 and which are introduced into the boundary contour 38 from the side thereof remote from the pot bottom.

FIG. 6 shows the mounted radiator fan 4 schematically as a simplified detail in a section along the rotor axis 14. For mounting, each of the connecting domes 12 is passed through one of the apertures 32 in the hub 26, and the fan wheel 22 is placed on the stabilizing vanes 16. During this process, the central centering ring 18 of the rotor 2 engages in the centering opening 36 of the fan wheel 22. In this way, the fan wheel 22 is positioned in a relatively precise manner since the centering ring 18 rests circumferentially on the inside of the boundary contour 38.

Each of the driver ribs 20 of the rotor is arranged with a form-locking engagement in one of the corresponding slots 40 in the fan wheel 22. The fan wheel 22 is thus positioned by the centering opening 36 and the centering ring 18, thereby making it possible to choose relatively large manufacturing tolerances between the connecting dome 12 and the respective corresponding aperture 32. In a subsequent working step, each of the connecting domes 12 is heated at the free end 42 and staked and, in the process, deformed into a rivet head 44 which fills the respective depression 30. In this way, the fan wheel 22 is fixed form-lockingly on the rotor 2, wherein the front side 22*a* and the respective rivet heads 44 form one plane. In this way, turbulence in an air flow to which the radiator fan 4 is subjected on the front side 22*a* during operation is avoided. A form-locking connection is one that connects two elements together due to the shape of the elements themselves (e.g. a ball and socket), as opposed to a force-locking connection, which locks the elements together by force external to the elements (e.g. a screw).

The hub 26 furthermore forms an end cover 26 of the rotor 2 and thus protects the latter from damage, which could be caused, in particular, by the objects contained in the air flow. The transmission of the rotary motion of the rotor 2 to the fan wheel is accomplished to a relatively large extent by the driver ribs 22 arranged in the slots 40. In this way, the connecting domes 12 are subject to relatively little stress during operation, and the nonpositive engagement is relatively secure.

The invention is not restricted to the illustrative embodiment described above. On the contrary, other variants of the invention can also be derived therefrom by a person skilled in the art without exceeding the subject matter of the invention. In particular, all individual features described in connection with the illustrative embodiment can also be combined in some other way without exceeding the subject matter of the invention.

The following is a summary list of reference numerals and the corresponding structure used in the above description of the invention:

2 rotor
4 radiator fan
6 laminated rotor core
8 rotor lamination
10 plastic overmolding
12 connecting dome
14 rotor axis
16 stabilizing rib
18 centering ring
20 driver rib
22 fan wheel
22*a* front side
22*b* rear side
24 fan blade
26 hub
28 stabilizing ring
30 depression
32 aperture
34 rib structure

36 centering opening
38 boundary contour
40 slot
42 free end
44 rivet head
46 cover

The invention claimed is:

1. A radiator fan of a motor vehicle, the radiator fan comprising:

a fan wheel having a hub with a number of apertures formed therein;

an electric-motor rotor attached to said fan wheel via a form-locking connection, said electric-motor rotor having at least one connecting dome formed integrally thereinwith, said connecting dome protruding through a respective one of said apertures in said hub and deformed in a form of a rivet head at a free end to produce the form-locking connection, said electric-motor rotor having a rotary axis; and a number of stabilizing ribs formed on a rotor side of said at least one connecting dome and being formed integral with said at least one connecting dome, said stabilizing ribs extending away from said at least one connecting dome and are in direct mechanical contact with said at least one connecting dome, said stabilizing ribs are disposed parallel to the rotary axis.

2. The radiator fan according to claim 1, wherein said at least one connecting dome extends parallel to the rotor axis.

3. The radiator fan according to claim 1, wherein said at least one connecting dome is one of at least two connecting domes disposed at a same distance radially from the rotor axis.

4. The radiator fan according to claim 1, wherein:

said hub has a pot-shaped centering opening formed therein; and said electric-motor rotor contains an end face having a surface with a centering ring centrally on said surface, said centering ring arching axially toward said hub and engaging in said pot-shaped centering opening in said hub.

5. The radiator fan according to claim 4, wherein said centering ring and said pot-shaped centering opening in said hub form a form locking connection.

6. The radiator fan according to claim 4, wherein:

said hub has a plurality of slots formed therein; and said electric-motor rotor has a number of driver ribs each engaging in a corresponding one of said slots in said hub.

7. The radiator fan according to claim 6, wherein said driver ribs are formed integrally on said centering ring.

8. The radiator fan according to claim 6, wherein said slots are introduced into a boundary contour of said centering opening.

9. The radiator fan according to claim 6, wherein:

said electric-motor rotor has a laminated rotor core with an electrically insulating plastic over-molding; and said at least one connecting dome, said centering ring and/or said driver rib is/are integral with said electrically insulating plastic over-molding of said laminated rotor core of said electric-motor rotor.

10. The radiator fan according to claim 6, wherein said driver ribs are radial driver ribs.

11. The radiator fan according to claim 1, wherein said hub at least partially forms a cover for said electric-motor rotor.

12. The radiator fan according to claim 1, wherein said at least one connecting dome is one of at least four connecting domes disposed at a same distance radially from the rotor axis.

13. The radiator fan according to claim 1, wherein the radiator fan is a main fan of the motor vehicle.

14. A radiator fan of a motor vehicle, the radiator fan comprising:

a fan wheel having a hub with a number of apertures formed therein and a pot-shaped centering opening formed therein;

an electric-motor rotor attached to said fan wheel via a form-locking connection, said electric-motor rotor having at least one connecting dome formed integrally thereinwith, said at least one connecting dome protruding through a respective one of said apertures in said hub and deformed in a form of a rivet head at a free end to produce the form-locking connection, said electric-motor rotor containing an end face having a surface with a centering ring centrally on said surface, said centering ring arching axially toward said hub and engaging in said pot-shaped centering opening in said hub;

said hub further having a cylindrical boundary contour and a plurality of spaced apart ribs extending from said cylindrical boundary contour to said pot-shaped centering opening; and said centering ring and said pot-shaped centering opening each having a radius being smaller than a radius of said electric-motor rotor or said hub.

* * * * *